US007218292B2

(12) United States Patent
Kashio et al.

(10) Patent No.: US 7,218,292 B2
(45) Date of Patent: May 15, 2007

(54) METHOD OF DRIVING PLASMA DISPLAY PANEL

(75) Inventors: Yukinori Kashio, Tokyo (JP); Mitsuhiro Ishizuka, Tokyo (JP); Shinya Tsuchida, Tokyo (JP); Takatoshi Shoji, Tokyo (JP); Koji Hashimoto, Tokyo (JP); Akihiro Ueki, Tokyo (JP)

(73) Assignee: Pioneer Corporation, Tokyo (JP)

( * ) Notice: Subject to any disclaimer, the term of this patent is extended or adjusted under 35 U.S.C. 154(b) by 607 days.

(21) Appl. No.: 10/731,140

(22) Filed: Dec. 10, 2003

(65) Prior Publication Data

US 2004/0113871 A1 Jun. 17, 2004

(30) Foreign Application Priority Data

Dec. 10, 2002 (JP) ..... 2002-357517

(51) Int. Cl.
*G09G 3/28* (2006.01)

(52) U.S. Cl. ..... 345/60; 345/66

(58) Field of Classification Search ..... 313/582, 313/584, 586, 574, 633; 315/169.1, 169.4; 345/41, 60–68; 348/797
See application file for complete search history.

(56) References Cited

U.S. PATENT DOCUMENTS 6,642,912 B2 * 11/2003 Furutani ..... 345/68
6,696,794 B2 * 2/2004 Ishizuka ..... 315/169.1
6,784,859 B2 * 8/2004 Setoguchi et al. ..... 345/60
7,009,584 B2 * 3/2006 Kim ..... 345/60

FOREIGN PATENT DOCUMENTS

JP 11-24626 * 1/1999
JP 2000-122602 A 4/2000
JP 2001-272948 A 10/2001
JP 2003-140609 * 5/2003

* cited by examiner

*Primary Examiner*—Nitin Patel
(74) *Attorney, Agent, or Firm*—Sughrue Mion, PLLC

(57) ABSTRACT

A method of driving a plasma display panel including (A) a first substrate including a first electrode, and a second electrode extending in parallel with the first electrode and defining a display area with the first electrode therebetween, and (B) a second substrate including a third electrode facing the first and second electrodes and extending perpendicularly to the first and second electrodes, includes (a) applying a serrate voltage having an inclined waveform in which a voltage varies with the lapse of time, to the first and/or second electrodes, and (b) applying a preliminary charge-eliminating pulse voltage to the first and/or second electrodes after the a charge-eliminating discharge has been generated due to the serrate voltage, wherein the preliminary charge-eliminating pulse voltage eliminates electric charges only when electric charges have not been sufficiently eliminated.

26 Claims, 17 Drawing Sheets

METHOD OF DRIVING PLASMA DISPLAY PANEL

BACKGROUND OF THE INVENTION

1. Field of the Invention

The invention relates to a method of driving a plasma display panel, and more particularly to a method of driving an AC memory-operation type plasma display panel.

2. Description of the Related Art

A plasma display panel is structurally grouped into a DC (direct current) type panel having electrodes exposed to discharge gas, and an AC (alternating current) type panel having electrodes covered with a dielectric layer to prevent from being directly exposed to discharge gas. An AC type plasma display panel is further structurally grouped into a memory-operation type panel which operates by virtue of a memory function caused by a function of a dielectric layer to store electric charges therein, and a refresh-operation type panel which operates not using a memory function.

Hereinbelow are explained a structure of an AC memory-operation type plasma display panel and a method of driving the same.

FIG. 1 is a perspective broken view of a conventional AC type plasma display panel suggested in Japanese Patent Application Publication No. 2001-272948.

As illustrated in FIG. 1, a plasma display panel 20 includes an electrically insulating front substrate 1A and an electrically insulating rear substrate 1B.

On the front substrate 1A are arranged a scanning electrode 9 and a common electrode 10 spaced away from each other and in parallel with each other.

Each of the scanning electrode 9 and the common electrode 10 is comprised of a bus electrode 3 for presenting electrical conductivity, and a principal discharge electrode 2 formed on the bus electrode 3 for generating discharge therefrom. The principal discharge electrode 2 in the plasma display panel 20 is comprised of a transparent electrode composed of indium-tin oxide (ITO) or $SnO_2$ for preventing reduction in light transmissivity.

The scanning electrode 9 and the common electrode 10 are covered with a dielectric layer 4*a*, which is covered with a protection film 5 composed of magnesium oxide to protect the dielectric layer 4*a* from discharges.

On the rear substrate 1B is arranged a plurality of data electrodes 6 extending in parallel with one another and perpendicularly to the scanning electrode 9 and the common electrode 10.

The data electrodes 6 are covered with a dielectric layer 4*b*. On the dielectric layer 4*b* is formed a plurality of partition walls 7 extending in parallel with the data electrodes 6 for defining discharge areas and display cells.

A phosphor layer 8 is formed on an exposed surface of the dielectric layer 4*b* and sidewalls of the partition walls 7 for converting ultra-violet rays generated by discharges, into visible light. By forming color phosphor layers in each of display cells, it would be possible to display colored images. For instance, color phosphor layers of three primary colors, that is, red (R), green (G) and blue (B) may be formed.

Discharge gas is introduced into a space sandwiched between the front and rear substrates 1A and 1B and partitioned by the partition walls 7. For instance, discharge gas is comprised of helium (He), neon (Ne) and xenon (Xe) alone or in combination.

FIG. 2 is a plan view of the plasma display panel 20 as viewed from a viewer.

As illustrated in FIG. 2, the scanning electrode 9 and the common electrode 10 extend in a row direction in parallel with each other. A gap formed between the scanning electrode 9 and the common electrode 10 is called a discharge gap 12, in which surface-discharge is generated between the scanning electrode 9 and the common electrode 10.

Hereinbelow, a method of driving the plasma display panel 20 is explained with reference to FIG. 3.

FIG. 3 is a timing chart showing waveforms of pulse voltages applied to the scanning electrode 9, the common electrode 10 and the data electrode 6, and further showing waveforms of a light emitted in normal operation and at generation of intensive discharge.

It is assumed in FIG. 3 that the previous sub-field is selected, but the illustrated sub-field is not selected.

Voltages are applied separately to each of the scanning and data electrodes 9 and 6, and voltages having a common waveform are applied to all of the common electrodes 10.

As illustrated in FIG. 3, a fundamental cycle for driving the plasma display panel 20 includes a reset period (A) in which display cells are reset for causing discharges to be readily generated in the subsequent period (B), a scanning period (B) in which it is selected which display cell or cells is(are) to be turned on or off, a sustaining period (C) in which discharges are generated in all of the selected display cells. Such a fundamental cycle is called a sub-field.

In the reset period, a sustaining-discharge eliminating pulse Pse is applied to all of the scanning electrodes 9 to generate charge-eliminating discharge to eliminate wall charges accumulated due to previous sustaining-discharge pulses.

Herein, the term "eliminate" should not be limited to elimination of all of wall charges, but should be interpreted as including reduction in wall charges for smoothly generating subsequent preliminary discharges, data-writing discharges and sustaining discharges.

The sustaining-discharge eliminating pulse Pse is a pulse voltage having an inclined waveform or a serrate waveform in which a voltage varies with the lapse of time.

Then, a positive priming pulse Pp+ is applied to all of the scanning electrodes 9 for causing compulsory discharges in all of the display cells. While the positive priming pulse Pp+ is being applied to the scanning electrode 9, a negative priming pulse Pp− is applied to the common electrodes 10.

Then, a priming-eliminating pulse Ppe is applied to all of the scanning electrodes 9 for causing charge-eliminating discharges to eliminate wall charges having been accumulated due to the positive priming pulse Pp+. The term "eliminate" should not be limited to elimination of all of wall charges, but should be interpreted as including reduction in wall charges for smoothly generating subsequent data-writing discharges and sustaining discharges.

Preliminary discharge caused by application of the positive priming pulse Pp+ and elimination of the preliminary discharge caused by application of the priming-eliminating pulse Ppe make subsequent data-writing discharge be readily generated.

Following the priming-eliminating pulse Ppe, a scanning base pulse Pbw is applied to the scanning electrode 9.

The positive priming pulse Pp+ and the priming-eliminating pulse Ppe have an inclined waveform or a serrate waveform in which a voltage raises or lowers with the lapse of time. Discharge generated by application of a voltage having such an inclined waveform is just weak discharge which can extend only in the vicinity of the discharge gap 12.

The above-mentioned preliminary discharge and charge-eliminating discharge are generated independently of images. Hence, light emission caused by those discharges is observed as background luminance. If the thus observed background luminance is at high level, contrast would be deteriorated, and hence, quality of images is degraded.

An operation of the plasma display panel 20 caused by the sustaining-discharge eliminating pulse Pse in a cross-section A1–A2 (see FIG. 2) of the data electrode 6 in a display cell is explained hereinbelow with reference to FIG. 4 and FIGS. 5A to 5E.

FIG. 4 illustrates the sustaining-discharge eliminating pulse Pse over a sustaining period to the next reset period, and FIGS. 5A to 5E illustrate wall charges in a reset period in the case that weak discharges are stably generated.

In a conventional method of driving the plasma display panel 20, a voltage Vs is applied to the scanning electrode 9, and the common electrode 10 is grounded at a final sustaining discharge in a sustaining period.

Thus, as illustrated in FIG. 5A, negative electric charges are accumulated on the dielectric layer 4*a* above the scanning electrode 9 and positive electric charges are accumulated on the dielectric layer 4*a* above the common electrode 10 immediately before application of the sustaining-discharge eliminating pulse Pse and after sustaining discharge was generated. In contrast, positive electric charges are accumulated on the dielectric layer 4*b* above the data electrode 6, as illustrated in FIG. 5A.

During the application of the sustaining-discharge eliminating pulse Pse to the scanning electrode 9, the common electrode 10 is kept at the voltage Vs, and a voltage having an inclined or serrate waveform in which a voltage gradually varies to GND from the voltage Vs with the lapse of time is applied to the scanning electrode 9 (hereinbelow, such a voltage is referred to as "a serrate voltage"). After the application of the serrate voltage, when a sum of a voltage externally applied to the electrodes 9 and 10 and a voltage caused by wall charges exceeds a threshold voltage at which discharge starts, surface-discharge is generated between the scanning electrode 9 and the common electrode 10.

The surface electrode starts at a time Tfsw (see FIG. 4). If the serrate voltage has an inclination of about 10V/microsecond or smaller, the surface-discharge is generated as weak discharge gradually expanding as the serrate voltage varies, as illustrated in FIG. 5B.

As illustrated in FIG. 5C, weak discharge is generated between the scanning electrode 9 and the common electrode 10 further at a time Tfss (see FIG. 4).

When a sum of a voltage externally applied to the electrodes 9 and 6 and a voltage caused by wall charges exceeds a threshold voltage at which discharge starts, cross-discharge is generated between the scanning electrode 9 and the data electrode 6 wherein the data electrode 6 is at a positive voltage and the scanning electrode 9 is at a negative voltage. The cross-discharge starts at a time Tfm (see FIG. 4).

As shown in FIG. 4, the time Tfsw is earlier than the time Tfm at which the cross-discharge is generated between the scanning electrode 9 and the data electrode 6. That is, since the surface-discharge has been generated between the scanning electrode 9 and the common electrode 10, ions and metastables already exist in a discharge space, namely, the discharge space is already activated. Accordingly, the cross-discharge is stably generated between the scanning electrode 9 and the data electrode 6, as illustrated in FIG. 5D.

After the application of the sustaining-discharge eliminating pulse Pse to the scanning electrode 9, electric charges are accumulated as illustrated in FIG. 5E.

An operation of the plasma display panel 20 caused by the priming-eliminating pulse Ppe is explained hereinbelow with reference to FIG. 6 and FIGS. 7A to 7D.

FIG. 6 illustrates waveforms of the positive priming pulse Pp+ and the priming-eliminating pulse Ppe, and FIGS. 7A to 7D illustrate wall charges in a reset period.

While the positive priming pulse Pp+ having an inclined waveform is applied to the scanning electrode 9, the common electrode 10 is kept at GND.

When a sum of a voltage externally applied to the electrodes 9 and 10 and a voltage caused by wall charges exceeds a threshold voltage at which discharge starts, surface-discharge is generated between the scanning electrode 9 and the common electrode 10. The surface-discharge is generated as weak discharge gradually expanding as the serrate voltage varies, similarly to discharge generated by the application of the sustaining-discharge eliminating pulse Pse to the scanning electrode 9. The surface-discharge rearranges electric charges existing in the vicinity of the discharge gap 12.

At the same time, cross-discharge is generated between the scanning electrode 9 and the data electrode 6, resulting in that positive electric charges are accumulated on the dielectric layer 4*b* above the data electrode 6.

After the application of the positive priming pulse Pp+ to the scanning electrode 9 has been terminated, as illustrated in FIG. 7A, negative electric charges are accumulated on the dielectric layer 4*a* above the scanning electrode 9, positive electric charges are accumulated on the dielectric layer 4*a* above the common electrode 10, and positive electric charges are accumulated on the dielectric layer 4*b* above the date electrode 6.

While the priming-eliminating pulse Ppe having a negatively inclined waveform is applied to the scanning electrode 9, the common electrode 10 is kept at the voltage Vs.

After the application of the priming-eliminating pulse Ppe to the scanning electrode 9, when a sum of a voltage externally applied to the electrodes 9 and 10 and a voltage caused by wall charges exceeds a threshold voltage at which discharge starts, surface-discharge is generated between the scanning electrode 9 and the common electrode 10. The surface-discharge starts at a time Tfsw (see FIG. 4). The surface-discharge is generated as weak discharge gradually expanding as the serrate voltage varies, as illustrated in FIG. 7B.

When a sum of a voltage externally applied to the electrodes 9 and 6 and a voltage caused by wall charges exceeds a threshold voltage at which discharge starts, cross-discharge is generated between the scanning electrode 9 and the data electrode 6. The cross-discharge starts at a time Tfm (see FIG. 4).

Weak discharge is generated between the scanning electrode 9 and the common electrode 10 also at a time Tfss (see FIG. 6)

The time Tfsw at which the surface-discharge is generated between the scanning electrode 9 and the common electrode 10 is earlier than the time Tfm at which the cross-discharge is generated between the scanning electrode 9 and the data electrode 6. That is, when the cross-discharge is generated between the scanning electrode 9 and the data electrode 6, the surface-discharge has been already generated between the scanning electrode 9 and the common electrode 10, as illustrated in FIGS. 7B and 7C.

After the application of the priming-eliminating pulse Ppe to the scanning electrode 9 has been terminated, electric charges are arranged such that operation in the subsequent scanning period can be smoothly carried out, as illustrated in FIG. 7D. That is, negative electric charges are accumulated on the dielectric layer 4*a* above the scanning electrode 9, positive electric charges are accumulated on the dielectric layer 4*a* above the common electrode 10, and positive electric charges are accumulated on the dielectric layer 4*b* above the data electrode 6.

When not selected in the subsequent scanning period, that is, when data-writing discharge is not generated, wall charges are reduced to such a degree that discharge is not generated in a sustaining period.

In a scanning period in which discharge is generated to select a display cell in which a light is to be emitted, a scanning pulse Pw is applied to the scanning electrodes 9 one by one at different timings from one another, and a data pulse Pd having a voltage Vd is applied to the data electrode 6 in accordance with images to be displayed and in synchronization with a timing at which the scanning pulse was applied. The voltage Vd is equal to about 70V, for instance. In a display cell in which while the scanning pulse Pw is applied to scanning electrode 9, the data pulse Pd is applied to the data electrode 6, cross-discharge is generated between the scanning electrode 9 and the data electrode 6, and the cross-discharge induces surface-discharge to be generated between the scanning electrode 9 and the common electrode 10. A series of these actions is called data-writing discharge.

As a result of the generation of the data-writing discharge, positive electric charges are accumulated on the dielectric layer 4*a* above the scanning electrode 9, negative electric charges are accumulated on the dielectric layer 4*a* above the common electrode 10, and negative electric charges are accumulated on the dielectric layer 4*b* above the data electrode 6.

As a result of first sustaining-discharge, negative electric charges are accumulated on the dielectric layer 4*a* above the scanning electrode 9, and positive electric charges are accumulated on the dielectric layer 4*a* above the common electrode 10.

In a second sustaining-pulse, a voltage has a polarity opposite to a polarity of a voltage to be applied to the scanning electrode 9 and the common electrode 10 in accordance with a first sustaining-pulse. Hence, a voltage caused by electric charges accumulated on the dielectric layer 4*a* is added to a voltage in the second sustaining-pulse, and accordingly, there is generated second sustaining-discharge.

Hereinafter, sustaining-discharges are generated in the same way. If surface-discharge is not generated by virtue of the first sustaining-pulse, discharge will not be generated due to subsequent sustaining-pulses.

A combination of the above-mentioned reset period, scanning period and sustaining period is called a sub-field.

In order to accomplish displaying images at gray scales, one field which is a period for displaying one scene is divided into a plurality of sub-fields, and the different number of sustaining-pulses is assigned to each of sub-fields. If one field is divided into N sub-fields, and a luminance ratio among the sub-fields is defined equal to $2^{(N-1)}$, it would be possible to display images at $2^N$ gray scales by selecting sub-fields to be displayed in a field and combining them with one another.

For instance, it is assumed that one field is divided into eight (8) sub-fields. Since the eighth power of two is equal to 256 ($2^8$=256), it is possible to display images at 256 gray scales by controlling on/off of each of the eight sub-fields.

The above-mentioned conventional method of driving the plasma display panel 20 is accompanied with problems that weak discharge is not generated, but intensive discharge is generated at a voltage beyond a voltage at which weak discharge is to be generated, in a pulse having an inclined waveform in which a voltage gradually varies with the lapse of time, and that there is generated a difference in a panel in intensity of weak discharges, and resultingly, wall charges are not arranged uniformly in the panel.

FIG. 8 illustrates electric lines of force in an electric field generated between the scanning electrode 9 and the common electrode 10. The reason for the above-mentioned problems is explained hereinbelow with reference to FIG. 8.

As shown with electric lines of force in FIG. 8, an electric field generated between the scanning electrode 9 and the common electrode 10 is curved about the discharge gap 12 as a center. Hence, the electric filed has a relatively small density in an area remote from the discharge gap 12, whereas the electric field has a relatively high density in an area close to the discharge gap 12. Accordingly, a remarkably intensive electric field is generated at the discharge gap 12.

FIGS. 9A to 9E illustrate arrangement of wall charges in a reset period in the case that there is generated intensive discharge.

In the conventional method of driving the plasma display panel 20, the voltage Vs is applied to the scanning electrode 9, and the common electrode 10 is kept at GND when final sustaining-discharge is generated in a sustaining period.

Accordingly, after the generation of the sustaining-discharge has been terminated and immediately before the sustaining-discharge eliminating pulse Pse is applied to the scanning electrode 9, negative electric charges are accumulated on the dielectric layer 4*a* above the scanning electrode 9, positive electric charges are accumulated on the dielectric layer 4*a* above the common electrode 10, and positive electric charges are accumulated on the dielectric layer 4*b* above the data electrode 6, as illustrated in FIG. 9A.

If an efficiency at which discharge is generated is lowered at the application of the sustaining-discharge eliminating pulse Pse, surface-discharge is not accidentally generated at the time Tfsw (see FIG. 9B), but is sometimes generated at a time later than the time Tfsw.

If surface-discharge is generated between the scanning electrode 9 and the common electrode 10 at a time later than the time Tfsw, a voltage difference higher than a voltage difference found at a time at which discharge should start is applied across the scanning electrode 9 and the common electrode 10, because a voltage in a pulse having an inclined waveform is lowered during the time Tfsw to the time at which surface-discharge is actually generated. As a result, the resultant surface-discharge expands to a higher degree than weak discharge, that is, there is generated discharge slightly more intensive than expected.

As mentioned above, a remarkably intensive electric field is generated at the discharge gap 12 formed between the scanning electrode 9 and the common electrode 10. Hence, if there is generated discharge slightly more intensive than expected, the discharge swiftly grows into intensive discharge which expands all over a display cell, as illustrated in FIG. 9C.

The time Tfss shown in FIG. 4 is an earliest time at which such intensive discharge may be generated.

If intensive discharge is generated, positive electric charges are accumulated entirely on the dielectric layer 4*a* above the scanning electrode 9, and negative electric charges are accumulated entirely on the dielectric layer 4*a* above the common electrode 10, as illustrated in FIG. 9D.

Hereinafter, since discharge is never generated during application of a pulse voltage having an inclined waveform, to the scanning electrode 9, wall charges are arranged as illustrated in FIG. 9E after the application of the sustaining-discharge eliminating pulse Pse. That is, positive electric charges are accumulated on the dielectric layer 4*b* above the data electrode 6, but positive electric charges are accumulated on the dielectric layer 4*a* above the scanning electrode 9, and negative electric charges are accumulated on the dielectric layer 4*a* above the common electrode 10, contrary to the arrangement of wall charges illustrated in FIG. 5E.

After the application of the sustaining-discharge eliminating pulse Pse to the scanning electrode 9, wall charges are re-arranged by the positive priming pulse Pp+ and the priming-eliminating pulse Ppe. Arrangement of wall charges by the pulses Pp+ and Ppe is accomplished by generating weak discharge, similarly to the sustaining-discharge eliminating pulse Pse. Hence, influence caused by intensive discharge generated when the sustaining-discharge eliminating pulse Pse is applied to the scanning electrode 9 can be eliminated in the vicinity of the discharge gap 12. However, it will be impossible to eliminate such influence all over a display cell. In particular, in an area remote from the discharge gap 12, positive electric charges remain accumulated on the dielectric layer 4*a* above the scanning electrode 9, and negative electric charges remain accumulated on the dielectric layer 4*a* above the common electrode 10.

In a subsequent scanning period, voltages applied to the electrodes 9 and 10 are determined such that the plasma display panel can stably operate when negative electric charges are accumulated on the dielectric layer 4*a* above the scanning electrode 9, and positive electric charges are accumulated on the dielectric layer 4*a* above the common electrode 10 (see FIG. 5E). Accordingly, if positive electric charges are accumulated on the dielectric layer 4*a* above the scanning electrode 9, and negative electric charges are accumulated on the dielectric layer 4*a* above the common electrode 10, the plasma display panel operates unstably.

In order to reduce a background luminance, the positive priming pulse Pp+ and the priming-eliminating pulse Ppe are not sometimes applied to the scanning electrode 9 in a certain sub-field. This is because it is possible to arrange wall charges similarly to the arrangement of wall charges found after the application of the priming-eliminating pulse Ppe, even after wall charges have been arranged by the sustaining-discharge eliminating pulse Pse. Hence, the plasma display panel can operate stably in a subsequent scanning period in the same way as a case in which the positive priming pulse Pp+ and the priming-eliminating pulse Ppe are applied to the scanning electrode 9.

However, if there is generated intensive discharge in the sustaining-discharge eliminating pulse Pse, positive electric charges are accumulated on the dielectric layer 4*a* above the scanning electrode 9, and negative electric charges are accumulated on the dielectric layer 4*a* above the common electrode 10, as illustrated in FIG. 9E. Since a subsequent scanning period starts in such a condition, there is caused erroneous light-emission, that is, light is emitted even in a non-selected display cell.

In addition, if positive electric charges accumulated on the dielectric layer 4*a* above the scanning electrode 9 and negative electric charges accumulated on the dielectric layer 4*a* above the common electrode 10 are not sufficiently eliminated, there is generated intensive discharge 30B (see FIG. 3) as erroneous discharge in a sustaining period, or the priming-eliminating pulse Ppe causes intensive discharge, and accordingly, there is generated intensive discharge 30B (see FIG. 3) as erroneous discharge in a sustaining period.

In order to prevent such erroneous light-emission, it is necessary to prevent generation of intensive discharge in the sustaining-discharge eliminating pulse Pse. If it is not possible to prevent generation of such intensive discharge, it would be necessary to prepare a countermeasure to such intensive discharge.

If an efficiency at which discharges are generated in the priming-eliminating pulse Ppe, similarly to the sustaining-discharge eliminating pulse Pse, weak discharge may not be generated between the scanning electrode 9 and the common electrode 10.

If discharge is generated later, the resultant discharge would be more intensive than weak discharge because of a higher voltage difference than a voltage difference found at a time at which discharge should start is applied across the scanning electrode 9 and the common electrode 10. Since a remarkably intensive electric field is generated at the discharge gap 12 formed between the scanning electrode 9 and the common electrode 10, the discharge swiftly grows into intensive discharge 30A (see FIG. 3) which expands all over a display cell. The time Tfss shown in FIG. 6 is an earliest time at which such intensive discharge 30A is generated.

The generation of intensive discharge results in that positive electric charges are accumulated entirely on the dielectric layer 4*a* above the scanning electrode 9, and negative electric charges are accumulated entirely on the dielectric layer 4*a* above the common electrode 10. This is the same arrangement of wall charges as the arrangement found after data-writing discharge has been generated in a selected display cell in a scanning period.

Accordingly, even if not selected in a subsequent scanning period, if intensive discharge 30A is generated in the priming-eliminating pulse Ppe, there would be generated discharge because of addition of wall charges to an externally applied voltage when a first sustaining-pulse Ps is applied to the electrodes. Discharges are continuously generated even in second and later sustaining pulses Pse.

As a result, there is caused erroneous light-emission, that is, light is emitted even in a non-selected display cell. In order to prevent such erroneous light-emission, it would be necessary to prevent generation of the intensive discharge 30A in the priming-eliminating pulse Ppe, or to eliminate influence exerted by the intensive discharge 30A, even if the intensive discharge 30A was generated.

As explained above, the conventional method of driving the plasma display panel 20 is accompanied with a problem that images are deteriorated as a result that light is emitted in a non-selected display cell, namely, there occurs erroneous light-emission.

For instance, Japanese Patent Application Publication 2000-122602 has suggested a method of driving a plasma display panel which method is capable of solving a problem of erroneous light-emission.

Specifically, in the suggested method, surface-discharge and cross-discharge in charge-eliminating discharge are generated temporally separately from each other.

However, the suggested method is accompanied with a problem that if the discharges are concurrently generated, it would be quite difficult to control electric charges accumulated above a data electrode with the result of erroneous operation in a scanning period.

Specifically, if a ratio at which discharges are generated is quite low, priming particles are soon reduced when a certain period of time passes after generation of discharge. Accordingly, if surface-discharge and cross-discharge are generated temporally separately from each other as in the above-mentioned method, even if cross-discharge is first generated as weak discharge, subsequent surface-discharge will be generated as intensive discharge.

Thus, even in the above-mentioned method, the problem that light is emitted in a non-selected cell due to intensive discharge is not always solved.

SUMMARY OF THE INVENTION

In view of the above-mentioned problem in the conventional method, it is an object of the present invention to provide a method of driving a plasma display panel which method is capable of, even if intensive discharge is accidentally generated, preventing erroneous light-emission due to the accidentally generated intensive discharge, and further preventing occurrence of phenomenon that an area which should be displayed dark is displayed bright due to erroneous light-emission.

In one aspect of the present invention, there is provided a method of driving a plasma display panel comprised of (A) a first substrate including at least one first electrode, and at least one second electrode extending in parallel with the first electrode and defining a display area with the first electrode therebetween, and (B) a second substrate including at least one third electrode facing the first and second electrodes and extending perpendicularly to the first and second electrodes, wherein a display cell is arranged at each of intersections of the first and second electrodes with the third electrode, the method including (a) applying a serrate voltage having an inclined waveform in which a voltage varies with the lapse of time, to at least one of the first and second electrodes, and (b) applying a preliminary charge-eliminating pulse voltage to at least one of the first and second electrodes after the a charge-eliminating discharge has been generated due to the serrate voltage, wherein the preliminary charge-eliminating pulse voltage eliminates electric charges only when electric charges have not been sufficiently eliminated.

It is preferable that the preliminary charge-eliminating pulse voltage carries out narrow-width charge-elimination.

It is preferable that the preliminary charge-eliminating pulse voltage has a pulse width in the range of 0.5 to 2 microseconds both inclusive.

It is preferable that a negative preliminary charge-eliminating pulse voltage is applied to the second electrode.

It is preferable that a positive preliminary charge-eliminating pulse voltage is applied to the first electrode.

It is preferable that negative and positive preliminary charge-eliminating pulse voltages are concurrently applied to the second and first electrodes, respectively.

The method may further include (c) applying a preliminary pre-eliminating adjusting pulse voltage to at least one of the first and second electrodes to cause generate discharge in a display cell in which electric charges have not been sufficiently eliminated, the step (c) being carried out between the steps (a) and (b).

It is preferable that the preliminary pre-eliminating adjusting pulse voltage is applied to an electrode other than an electrode to which the preliminary charge-eliminating pulse voltage is applied.

It is preferable that the preliminary pre-eliminating adjusting pulse voltage has a pulse width greater than a pulse width of the preliminary charge-eliminating pulse voltage.

It is preferable that the preliminary pre-eliminating adjusting pulse voltage is applied a plurality of times to at least one of the first and second electrodes in the step (c).

It is preferable that the preliminary pre-eliminating adjusting pulse voltage has a pulse width in the range of 2 to 10 microseconds both inclusive.

It is preferable that the preliminary pre-eliminating adjusting pulse voltage is applied to at least one of the first and second electrodes immediately before application of the preliminary charge-eliminating pulse voltage.

It is preferable that the preliminary pre-eliminating adjusting pulse voltage has the same polarity as that of the preliminary charge-eliminating pulse voltage.

It is preferable that the preliminary charge-eliminating pulse voltage carries out thick-width charge-elimination.

It is preferable that the preliminary charge-eliminating pulse voltage has a pulse width in the range of 2 to 50 microseconds both inclusive.

It is preferable that the preliminary charge-eliminating pulse voltage is comprised of a self-eliminating pulse voltage.

It is preferable that a preliminary pre-eliminating adjusting pulse voltage is applied to an electrode other than an electrode to which the self-eliminating pulse voltage is applied such that the preliminary pre-eliminating adjusting pulse voltage temporally overlaps the self-eliminating pulse voltage, to generate discharge in a display cell in which electric charges have not been sufficiently eliminated.

For instance, the self-eliminating pulse voltage has a pulse width in the range of 2 to 50 microseconds both inclusive.

It is preferable that the preliminary charge-eliminating pulse voltage is applied to at least one of the first and second electrodes as a part of a pulse voltage applied in a scanning period.

It is preferable that the preliminary pre-eliminating adjusting pulse voltage generates an electric field having a polarity opposite to a polarity of an electric field generated by the preliminary charge-eliminating pulse voltage.

It is preferable that a time at which cross-discharge is generated between the third electrode and one of the first and second electrodes is set earlier than a time at which surface-discharge is generated between the first and second electrodes.

It is preferable that a preliminary pulse voltage is applied to the third electrode in synchronization with a timing at which application of the preliminary charge-eliminating pulse voltage starts, the preliminary pulse voltage having a polarity opposite to a polarity of the preliminary charge-eliminating pulse voltage.

It is preferable that a preliminary pulse voltage is applied to the third electrode in synchronization with a timing at which application of the preliminary pre-eliminating adjusting pulse voltage starts, the preliminary pulse voltage having a polarity opposite to a polarity of the preliminary pre-eliminating adjusting pulse voltage.

It is preferable that the preliminary pulse voltage is equal to a data pulse voltage.

For instance, the preliminary pulse voltage has a pulse width in the range of 0.1 to 2 microseconds both inclusive.

It is preferable that n the preliminary pulse voltage has a pulse width equal to or smaller than a pulse width of the preliminary charge-eliminating pulse voltage.

The advantages obtained by the aforementioned present invention will be described hereinbelow.

In accordance with the above-mentioned present invention, a serrate voltage having an inclined waveform in which a voltage varies with the lapse of time is applied to the first and/or second electrodes to generate weak discharge. Hence, it is possible to prevent generation of intensive discharge.

Even if it is impossible to prevent generation of intensive discharge by application of the serrate voltage, it would be possible to prevent erroneous light-emission caused by intensive discharge, and further prevent occurrence of phenomenon that an area which should be displayed dark is displayed bright due to erroneous light-emission, by applying the preliminary charge-eliminating pulse voltage to the first and/or second electrodes.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

First Embodiment

Hereinbelow is explained a method of driving a plasma display panel, in accordance with the first embodiment with reference to FIG. 10.

Figure 1:
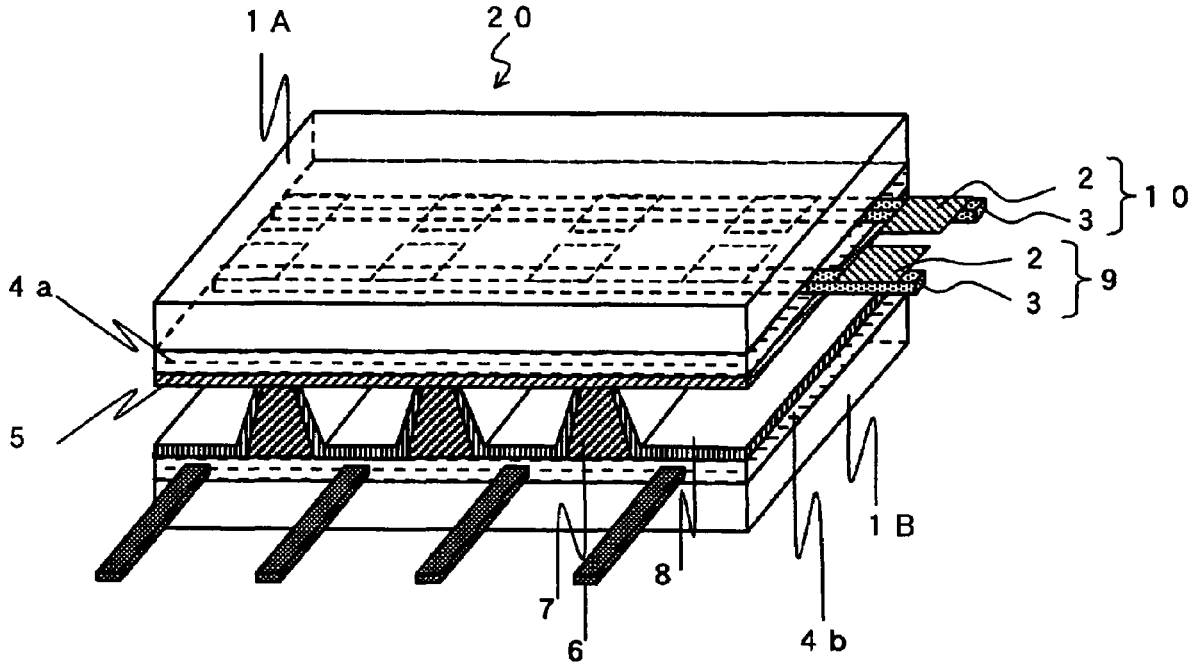
FIG.1 PRIOR ART
FIG. 1 is a perspective broken view of a conventional plasma display panel.
Figure 2:
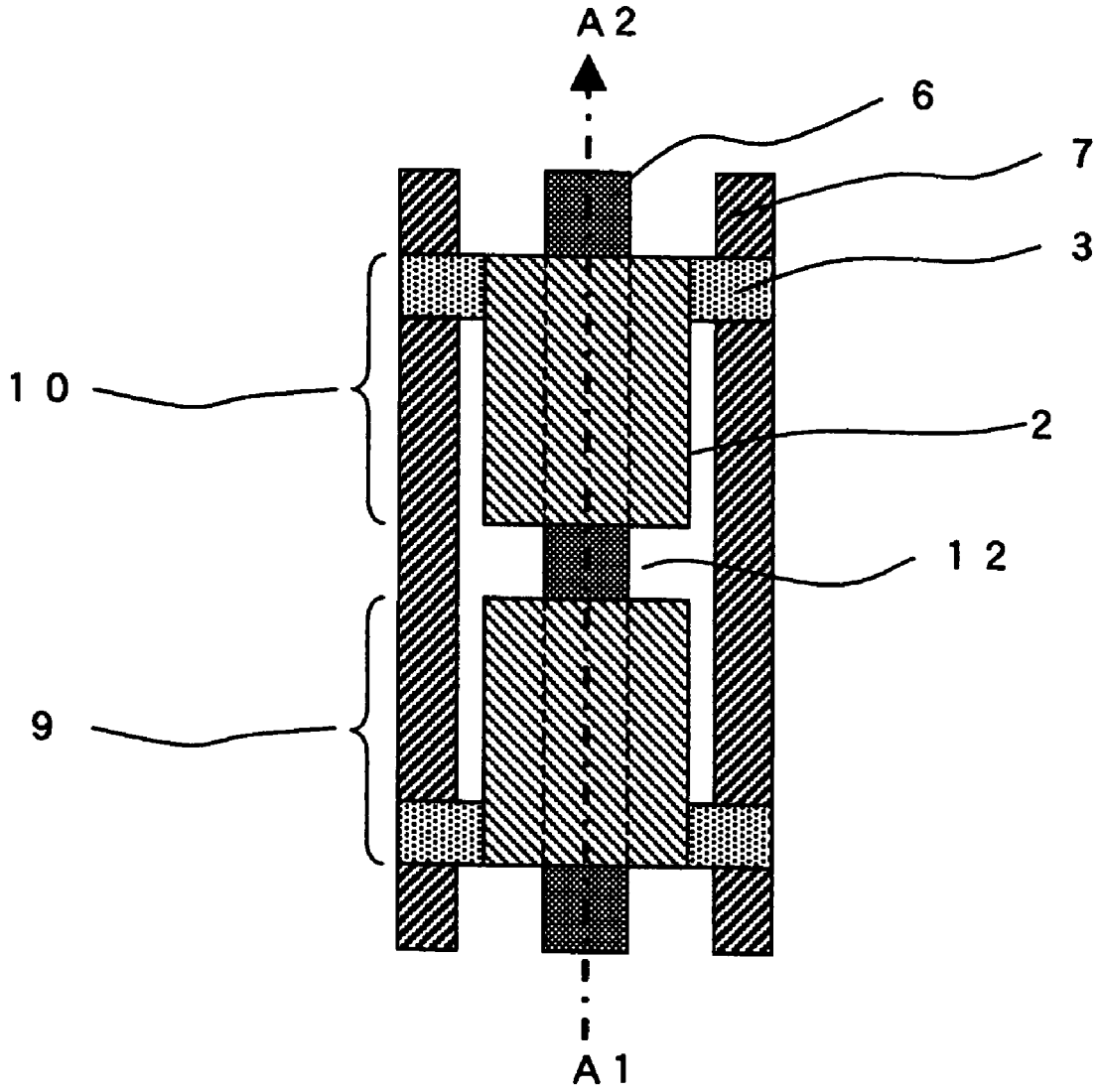
FIG.2 PRIOR ART
FIG. 2 is a plan view of the plasma display panel illustrated in FIG. 1, as viewed from a viewer.
Figure 3:
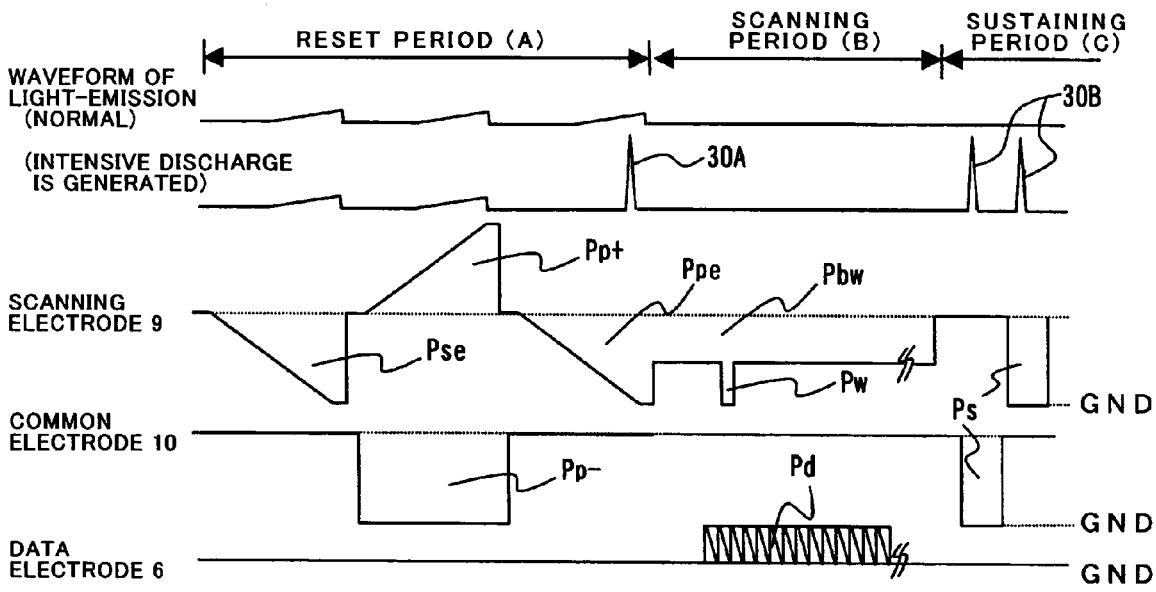
FIG.3 PRIOR ART
FIG. 3 is a timing chart showing waveforms of pulse voltages applied to electrodes, and further showing waveforms of a light emitted in normal operation and at generation of intensive discharge.
Figure 4:
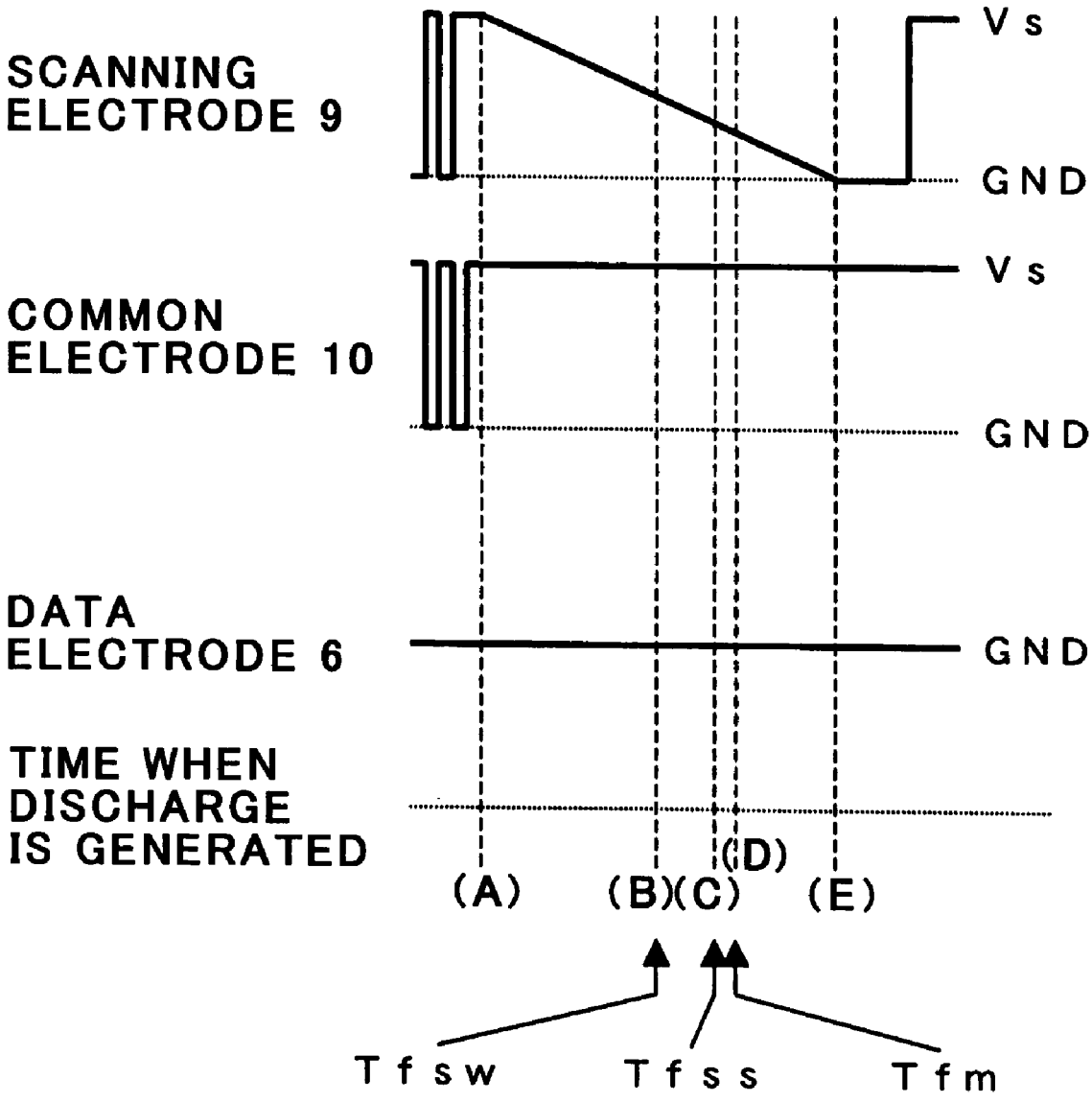
FIG.4 PRIOR ART
FIG. 4 is a partially enlarged view of FIG. 3.
Figure 5A:
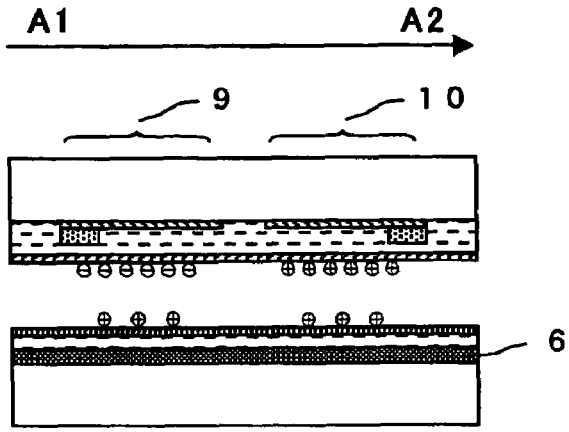
FIG.5A PRIOR ART
FIGS. 5A to 5E illustrate wall charges in a reset period in the case that weak discharges are stably generated, in the conventional plasma display panel.
Figure 5B:
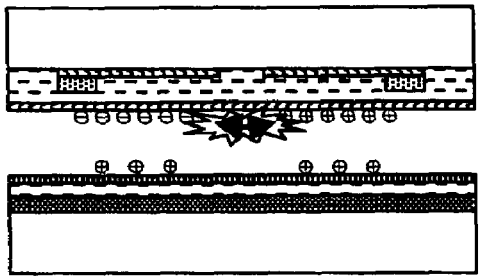
FIG.5B PRIOR ART
Figure 5C:
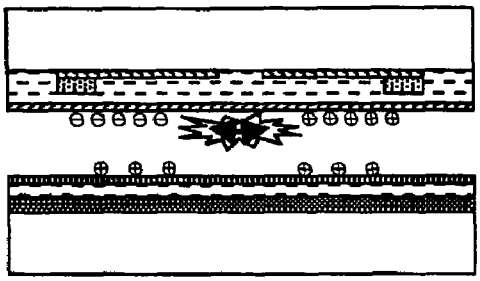
FIG.5C PRIOR ART
Figure 5D:
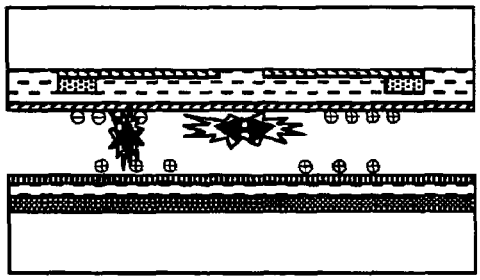
FIG.5D PRIOR ART
Figure 5E:
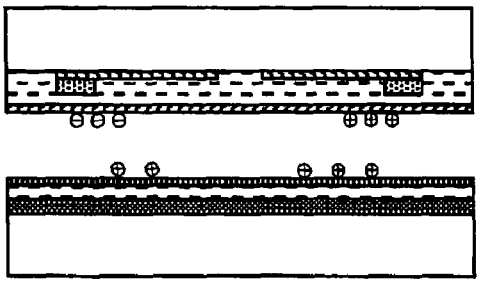
FIG.5E PRIOR ART
Figure 6:
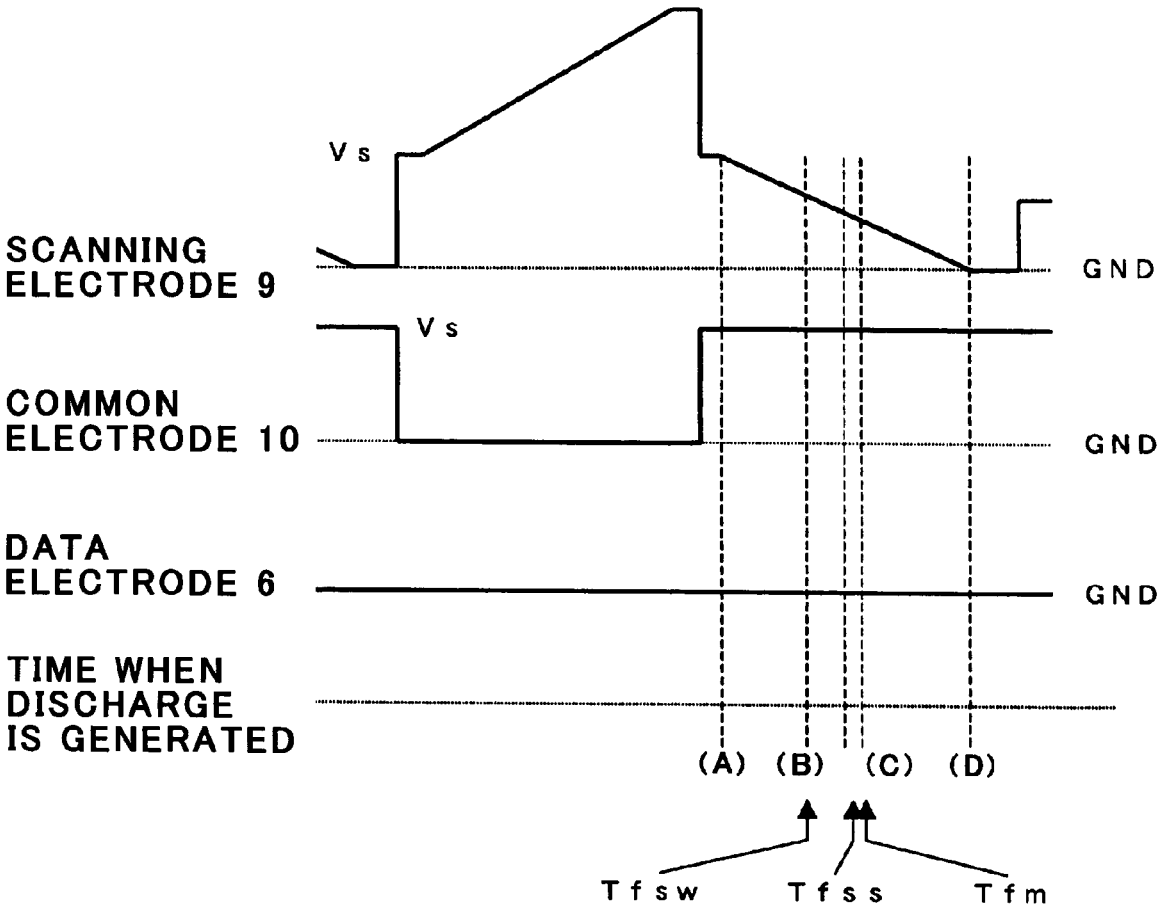
FIG.6 PRIOR ART
FIG. 6 is a partially enlarged view of FIG. 3.
Figure 7A:
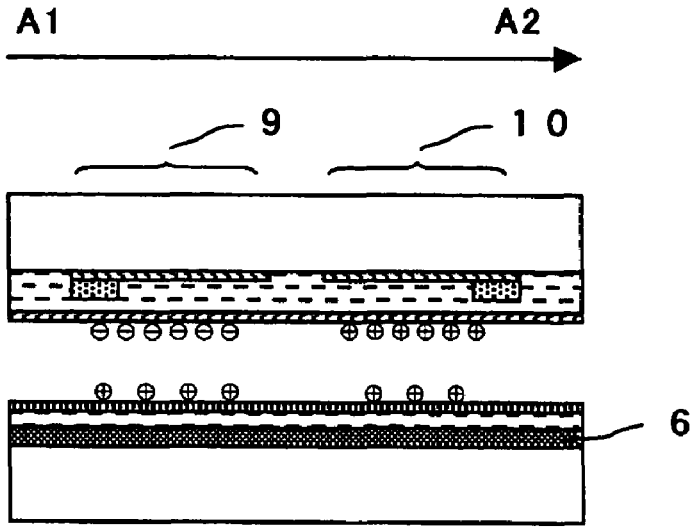
FIG.7A PRIOR ART
FIGS. 7A to 7D illustrate wall charges in a reset period in the conventional plasma display panel.
Figure 7B:
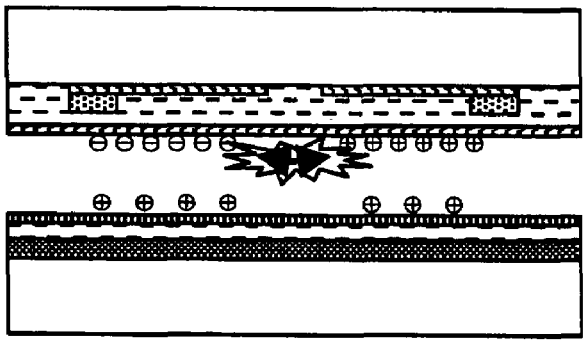
FIG.7B PRIOR ART
Figure 7C:
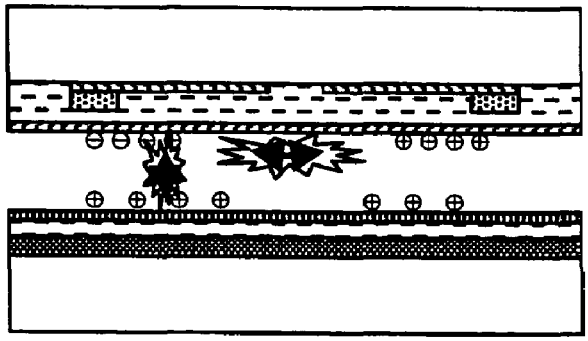
FIG.7C PRIOR ART
Figure 7D:
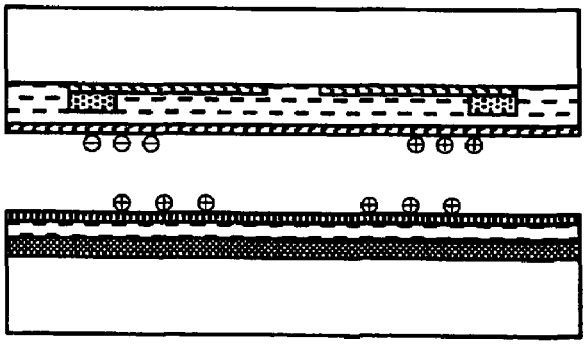
FIG.7D PRIOR ART

A plasma display panel to which the method in accordance with the first embodiment is carried out has the same structure as that of the conventional plasma display panel illustrated in FIG. 1.

Figure 10:
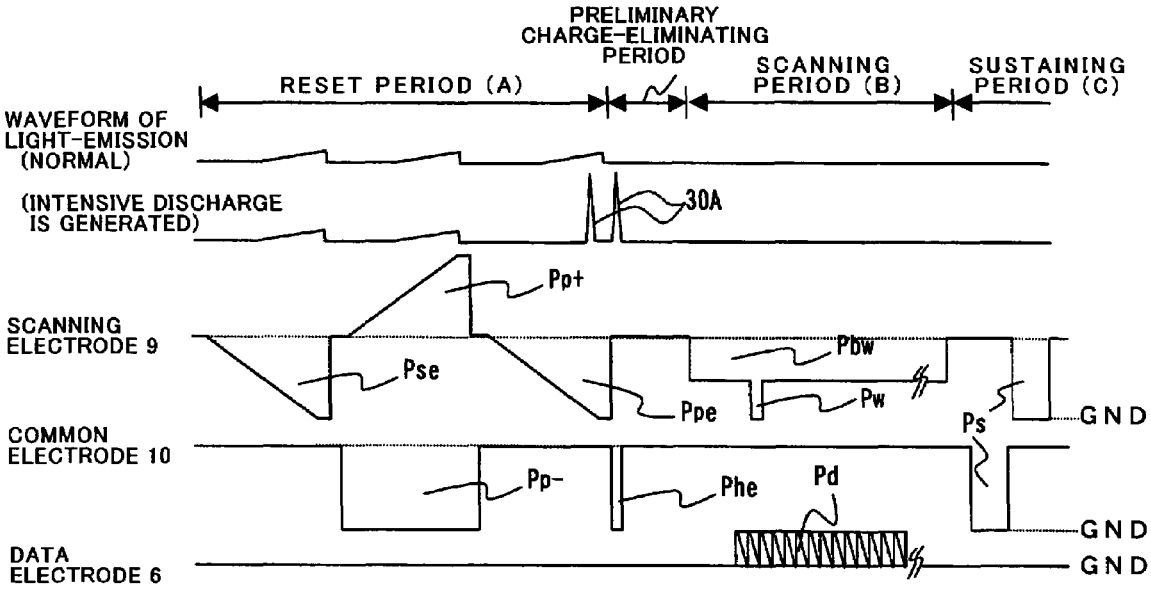
FIG. 10 is a timing chart showing waveforms of pulse voltages applied to electrodes, and further showing waveforms of a light emitted in normal operation and at generation of intensive discharge, in a method of driving a plasma display panel, in accordance with the first embodiment of the present invention.

FIG. 10 is a timing chart showing waveforms of pulse voltages applied to electrodes, and further showing waveforms of a light emitted in normal operation and at generation of intensive discharge, in the method in accordance with the first embodiment.

FIG. 10 illustrates waveforms of light-emission found when the previous sub-field is selected, and the present sub-field is not selected.

In the first embodiment, a preliminary charge-eliminating pulse Phe is applied to the common electrode 10 immediately after a priming-eliminating pulse Ppe has been applied to the scanning electrode 9. In the first embodiment, a preliminary charge-elimination period is arranged between a reset period and a scanning period. The preliminary charge-eliminating pulse Phe is applied to the common electrode 10 in the preliminary charge-elimination period.

The preliminary charge-eliminating pulse Phe causes discharge only in a display cell in which charges are not sufficiently eliminated, namely, intensive discharge 30A is generated, even though the preliminary charge-eliminating pulse Phe has been applied to the scanning electrode 9.

By applying the preliminary charge-eliminating pulse Phe to the common electrode 10, a voltage across the scanning electrode 9 and the common electrode 10 is lowered immediately after generation of the intensive discharge 30A, and hence, electric charges are not attracted to the scanning and common electrodes 9 and 10. As a result, it is possible to prevent generation of wall charges. Accordingly, it is possible to suppress generation of erroneous discharge (namely, the intensive discharge 30B) in scanning and sustaining periods following a reset period, and further prevent erroneous light-emission caused by the erroneous discharge, ensuring qualified images without occurrence of phenomenon that an area which should be displayed dark is displayed bright.

The preliminary charge-eliminating pulse Phe in the first embodiment carries out so-called narrow-width charge-elimination, and is designed to have a pulse width in the range of 0.5 to 2.0 microseconds. If intensive discharge is not generated in a reset period, the preliminary charge-eliminating pulse Phe is designed to have such a voltage that discharge is not generated.

The preliminary charge-eliminating pulse Phe has a voltage in the range of about −150 to −200V relative to a voltage of the scanning electrode 9. In the first embodiment, the preliminary charge-eliminating pulse Phe is designed to have a voltage of about −170V relative to a voltage of the scanning electrode 9.

In place of applying the negative preliminary charge-eliminating pulse Phe to the common electrode 10, a positive preliminary charge-eliminating pulse may be applied to the scanning electrode 9. As an alternative, a negative preliminary charge-eliminating pulse Phe and a positive preliminary charge-eliminating pulse may be concurrently applied to the common and scanning electrodes 10 and 9, respectively. In both cases, even when electric charges are not sufficiently eliminated because of generation of intensive discharge in a reset period or for any reasons, narrow-width charge-elimination can be carried out by setting a voltage difference between the scanning and common electrodes 9 and 10 at the application of the preliminary charge-eliminating pulse Phe, equal to or greater than a voltage at which discharge starts.

FIG. 10 illustrates waveforms of light-emission found when the previous sub-field is selected, and the present sub-field is not selected. However, it should be noted that waveforms of light-emission remain unchanged regardless of whether the previous and present sub-fields are selected or not.

Second Embodiment

Hereinbelow is explained a method of driving a plasma display panel, in accordance with the second embodiment with reference to FIG. 11.

A plasma display panel to which the method in accordance with the second embodiment is carried out has the same structure as that of the conventional plasma display panel illustrated in FIG. 1.

Figure 11:
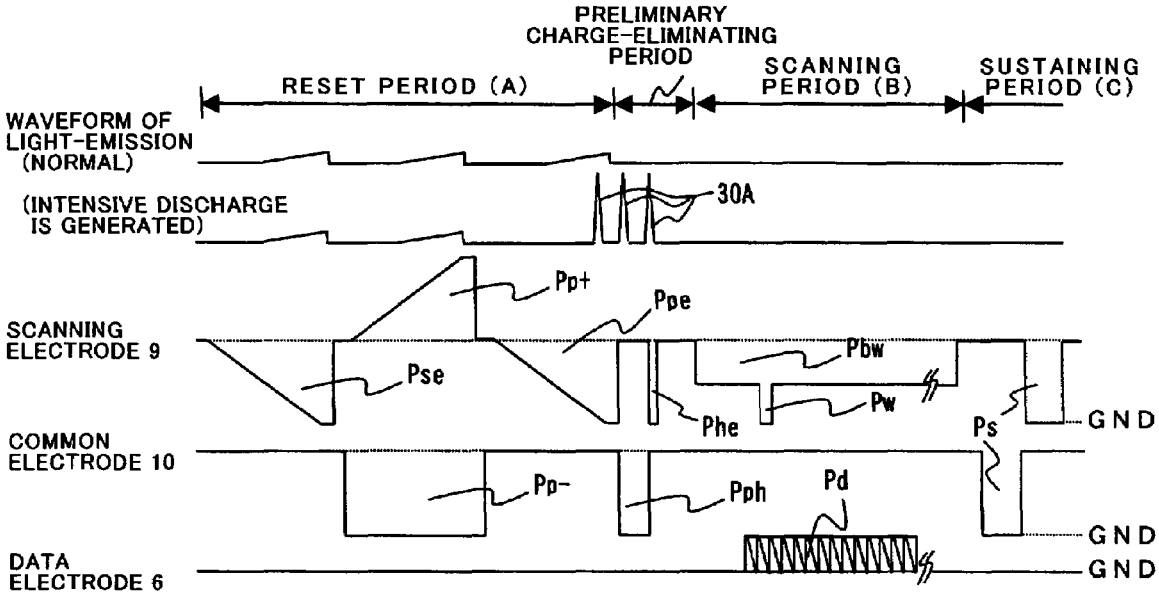
FIG. 11 is a timing chart showing waveforms of pulse voltages applied to electrodes, and further showing waveforms of a light emitted in normal operation and at generation of intensive discharge, in a method of driving a plasma display panel, in accordance with the second embodiment of the present invention.

FIG. 11 is a timing chart showing waveforms of pulse voltages applied to electrodes, and further showing waveforms of a light emitted in normal operation and at generation of intensive discharge, in the method in accordance with the second embodiment.

FIG. 11 illustrates waveforms of light-emission found when the previous sub-field is selected, and the present sub-field is not selected.

In the second embodiment, a preliminary charge-elimination period is arranged between a reset period and a scanning period. In the preliminary charge-elimination period, the above-mentioned preliminary charge-eliminating pulse Phe is applied to the scanning electrode 9, and further, a preliminary pre-eliminating adjusting pulse Pph is applied to the common electrode 10 immediately before the application of the preliminary charge-eliminating pulse Phe to the scanning electrode 9.

When the intensive discharge 30A is generated because of the application of the priming-eliminating pulse Ppe to the scanning electrode 9, wall charges are arranged in dependence on a timing at which the intensive discharge 30A is generated, namely, a voltage applied when the intensive discharge 30A is generated. As a result, there is caused a difference in discharges caused by the preliminary charge-eliminating pulse Phe in display cells in which charges are not sufficiently eliminated, and hence, there is caused non-uniformity in charge-elimination among display cells.

Even when charges are not sufficiently eliminated because of generation of intensive discharge in a reset period or for any reasons, it would be possible to optimize arrangement of wall charges and allow charge-eliminating discharge caused by the preliminary charge-eliminating pulse Phe to be stably generated, by applying the preliminary pre-eliminating adjusting pulse Pph immediately before the application of the preliminary charge-eliminating pulse Phe to thereby generate discharge. As a result, it is possible to suppress generation of erroneous discharge (namely, the intensive discharge 30B) in scanning and sustaining periods following a reset period, and further prevent erroneous light-emission caused by the erroneous discharge, ensuring qualified images without occurrence of phenomenon that an area which should be displayed dark is displayed bright.

The preliminary pre-eliminating adjusting pulse Pph is designed to have a pulse width greater than the same of the preliminary charge-eliminating pulse Phe. Specifically, the preliminary pre-eliminating adjusting pulse Pph is designed to have a pulse width in the range of 2 to 10 microseconds.

The preliminary pre-eliminating adjusting pulse Pph has a voltage in the range of about −150 to −200V relative to a voltage of the scanning electrode 9. In the second embodiment, the preliminary pre-eliminating adjusting pulse Pph is designed to have a voltage of about −170V relative to a voltage of the scanning electrode 9.

The negative preliminary charge-eliminating pulse Phe is applied to the scanning electrode 9, and the negative preliminary pre-eliminating adjusting pulse Pph is applied to the common electrode 10 in the second embodiment. To the contrary, a positive preliminary charge-eliminating pulse Phe may be applied to the common electrode 10, and a positive preliminary pre-eliminating adjusting pulse Pph may be applied to the scanning electrode 9.

The negative preliminary pre-eliminating adjusting pulse Pph is applied only once to the common electrode 10 in the second embodiment. As an alternative, for instance, after the negative preliminary pre-eliminating adjusting pulse Pph has been applied to the common electrode 10, the positive preliminary pre-eliminating adjusting pulse Pph and the negative preliminary charge-eliminating pulse Phe may be applied to the scanning and common electrodes 9 and 10, respectively. That is, the preliminary pre-eliminating adjusting pulse Pph may be applied twice or greater, if necessary.

FIG. 11 illustrates waveforms of light-emission found when the previous sub-field is selected, and the present sub-field is not selected. However, it should be noted that waveforms of light-emission remain unchanged regardless of whether the previous and present sub-fields are selected or not.

Third Embodiment

Hereinbelow is explained a method of driving a plasma display panel, in accordance with the third embodiment with reference to FIG. 12.

A plasma display panel to which the method in accordance with the third embodiment is carried out has the same structure as that of the conventional plasma display panel illustrated in FIG. 1.

Figure 12:
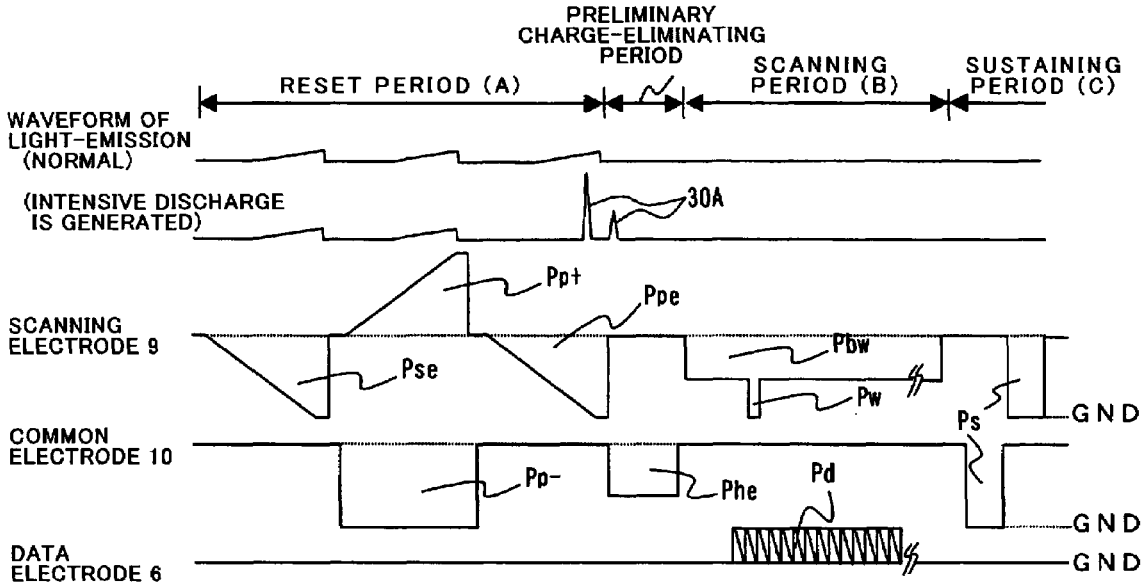
FIG. 12 is a timing chart showing waveforms of pulse voltages applied to electrodes, and further showing waveforms of a light emitted in normal operation and at generation of intensive discharge, in a method of driving a plasma display panel, in accordance with the third embodiment of the present invention.

FIG. 12 is a timing chart showing waveforms of pulse voltages applied to electrodes, and further showing waveforms of a light emitted in normal operation and at generation of intensive discharge, in the method in accordance with the third embodiment.

FIG. 12 illustrates waveforms of light-emission found when the previous sub-field is selected, and the present sub-field is not selected.

In the third embodiment, a preliminary charge-eliminating pulse Phe is applied to the common electrode 10 immediately after the application of the priming-eliminating pulse Ppe to the scanning electrode 9, similarly to the first embodiment. In the third embodiment, a preliminary charge-elimination period is arranged between a reset period and a scanning period, similarly to the first and second embodiments. The preliminary charge-eliminating pulse Phe is applied to the common electrode 10 in the preliminary charge-elimination period.

The third embodiment makes it possible to suppress generation of erroneous discharge (namely, the intensive discharge 30B) in scanning and sustaining periods following a reset period, and further prevent erroneous light-emission caused by the erroneous discharge, ensuring qualified images without occurrence of phenomenon that an area which should be displayed dark is displayed bright.

The preliminary charge-eliminating pulse Phe causes discharge only in a display cell in which charges have not been sufficiently eliminated, that is, there has been generated intensive discharge 30A, even though the priming-eliminating pulse Ppe was applied to the scanning electrode 9.

Whereas the preliminary charge-eliminating pulse Phe in the first embodiment carries out narrow-width charge-elimination, the preliminary charge-eliminating pulse Phe in the third embodiment carries out thick-width charge-elimination. Herein, thick-width charge-elimination means elimination of charges by applying a pulse having such a low voltage that there is not generated intensive discharge, to an electrode to thereby generate weak discharge. Since weak discharge is generated in thick-width charge-elimination, wall charges are generated in a small amount, which means that charges are eliminated to some degree.

Since a pulse for carrying out narrow-width charge-elimination has a narrow width like the preliminary charge-eliminating pulse Phe in the first embodiment, discharge for eliminating charges may not be generated while the preliminary charge-eliminating pulse Phe for carrying out narrow-width charge-elimination is being applied to the electrode. In contrast, the third embodiment makes it possible to generate charge-eliminating discharge more surely than the narrow-width charge-elimination by designing the preliminary charge-eliminating pulse Phe to have a sufficient pulse width to ensure generation of charge-eliminating discharge.

The preliminary charge-eliminating pulse Phe in the third embodiment is designed to have a lower voltage than a voltage of the preliminary charge-eliminating pulse Phe in the first embodiment. Whereas the preliminary charge-eliminating pulse Phe in the first embodiment has a voltage in the range of about −150V to −200V relative to a voltage of the scanning electrode 9, the preliminary charge-eliminating pulse Phe in the third embodiment is designed to have a voltage in the range of about −100V to −150V relative to a voltage of the scanning electrode 9. In the third embodiment, the preliminary charge-eliminating pulse Phe has a voltage of about −150V relative to a voltage of the scanning electrode 9.

Since the preliminary charge-eliminating pulse Phe in the third embodiment has a lower voltage than a voltage of the preliminary charge-eliminating pulse Phe in the first embodiment, as mentioned above, the preliminary charge-eliminating pulse Phe in the third embodiment is designed to have a longer pulse width than a pulse width of the preliminary charge-eliminating pulse Phe in the first embodiment in order to ensure generation of discharge when charges are not sufficiently eliminated because of generation of intensive discharge in a reset period or for any reasons. Specifically, whereas the preliminary charge-eliminating pulse Phe in the first embodiment is designed to have a pulse width in the range of 0.5 to 2.0 microseconds both inclusive, the preliminary charge-eliminating pulse Phe in the third embodiment is designed to have a pulse width in the range of 2 to 50 microseconds both inclusive.

FIG. 12 illustrates waveforms of light-emission found when the previous sub-field is selected, and the present sub-field is not selected. However, it should be noted that waveforms of light-emission remain unchanged regardless of whether the previous and present sub-fields are selected or not.

Fourth Embodiment

Hereinbelow is explained a method of driving a plasma display panel, in accordance with the fourth embodiment with reference to FIG. 13.

A plasma display panel to which the method in accordance with the fourth embodiment is carried out has the same structure as that of the conventional plasma display panel illustrated in FIG. 1.

Figure 13:
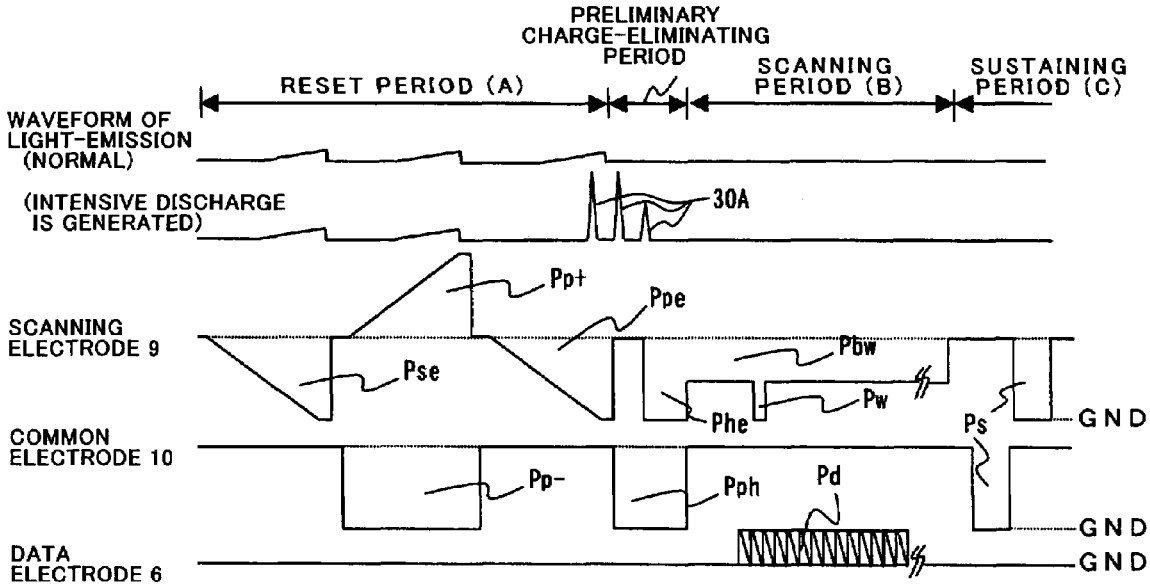
FIG. 13 is a timing chart showing waveforms of pulse voltages applied to electrodes, and further showing waveforms of a light emitted in normal operation and at generation of intensive discharge, in a method of driving a plasma display panel, in accordance with the fourth embodiment of the present invention.

FIG. 13 is a timing chart showing waveforms of pulse voltages applied to electrodes, and further showing waveforms of a light emitted in normal operation and at generation of intensive discharge, in the method in accordance with the fourth embodiment.

FIG. 13 illustrates waveforms of light-emission found when the previous sub-field is selected, and the present sub-field is not selected.

In the third embodiment, the above-mentioned preliminary pre-eliminating adjusting pulse Pph is applied to the common electrode 10, and further, the above-mentioned preliminary charge-eliminating pulse Phe is applied to the scanning electrode 9, similarly to the second embodiment. In the third embodiment, a preliminary charge-elimination period is arranged between a reset period and a scanning period. In the preliminary charge-elimination period, the preliminary pre-eliminating adjusting pulse Pph and the preliminary charge-eliminating pulse Phe are applied to the common electrode 10 and the scanning electrode 9, respectively.

Whereas the preliminary charge-eliminating pulse Phe was applied to the scanning electrode 9 as a single pulse independently of other pulses, the preliminary charge-eliminating pulse Phe in the third embodiment is applied to scanning electrode 9 as a part of a scanning base pulse Pbw and further as a self-eliminating pulse.

Herein, the term "self-eliminating" indicates generation of discharge caused by wall charges when a difference among voltages applied to electrodes is set equal to zero or set low. A self-eliminating pulse has a function of eliminating wall charges.

By applying the preliminary charge-eliminating pulse Phe to the scanning electrode 9 as a self-eliminating pulse, it would be possible to suppress generation of erroneous discharge (namely, the intensive discharge 30B) in scanning and sustaining periods following a reset period, and further prevent erroneous light-emission caused by the erroneous discharge, ensuring qualified images without occurrence of phenomenon that an area which should be displayed dark is displayed bright.

In addition, the preliminary charge-eliminating pulse Phe can be designed to have a pulse width shorter than a pulse width in a pulse for carrying out thick-width charge-elimination.

The preliminary charge-eliminating pulse Phe in the third embodiment has a pulse width in the range of 2 to 50 microseconds both inclusive.

The preliminary charge-eliminating pulse Phe in the fourth embodiment has a voltage in the range of about −150V to −200V relative to a voltage of the common electrode 10 generating charge-eliminating discharge. In the fourth embodiment, the preliminary charge-eliminating pulse Phe has a voltage of about −170V relative to a voltage of the common electrode 10 generating charge-eliminating discharge.

The preliminary pre-eliminating adjusting pulse Pph in the fourth embodiment has a voltage in the range of about −150V to −200V relative to a voltage of the common electrode 10 generating charge-eliminating discharge. In the fourth embodiment, the preliminary pre-eliminating adjusting pulse Pph has a voltage of about −170V relative to a voltage of the common electrode 10 generating charge-eliminating discharge.

The preliminary charge-eliminating pulse Phe was applied to the scanning electrode 9 immediately after the application of the preliminary pre-eliminating adjusting pulse Pph to the common electrode 10 in the second embodiment. That is, the preliminary charge-eliminating pulse Phe is applied to the scanning electrode 9 temporally separately from the preliminary pre-eliminating adjusting pulse Pph. In contrast, in the fourth embodiment, the preliminary charge-eliminating pulse Phe and the preliminary pre-eliminating adjusting pulse Pph are applied to the scanning and common electrodes 9 and 10, respectively, with the preliminary charge-eliminating pulse Phe temporally overlapping the preliminary pre-eliminating adjusting pulse Pph.

FIG. 13 illustrates waveforms of light-emission found when the previous sub-field is selected, and the present sub-field is not selected. However, it should be noted that waveforms of light-emission remain unchanged regardless of whether the previous and present sub-fields are selected or not.

Fifth Embodiment

Hereinbelow is explained a method of driving a plasma display panel, in accordance with the fifth embodiment with reference to FIGS. 14 to 17.

Figure 14:
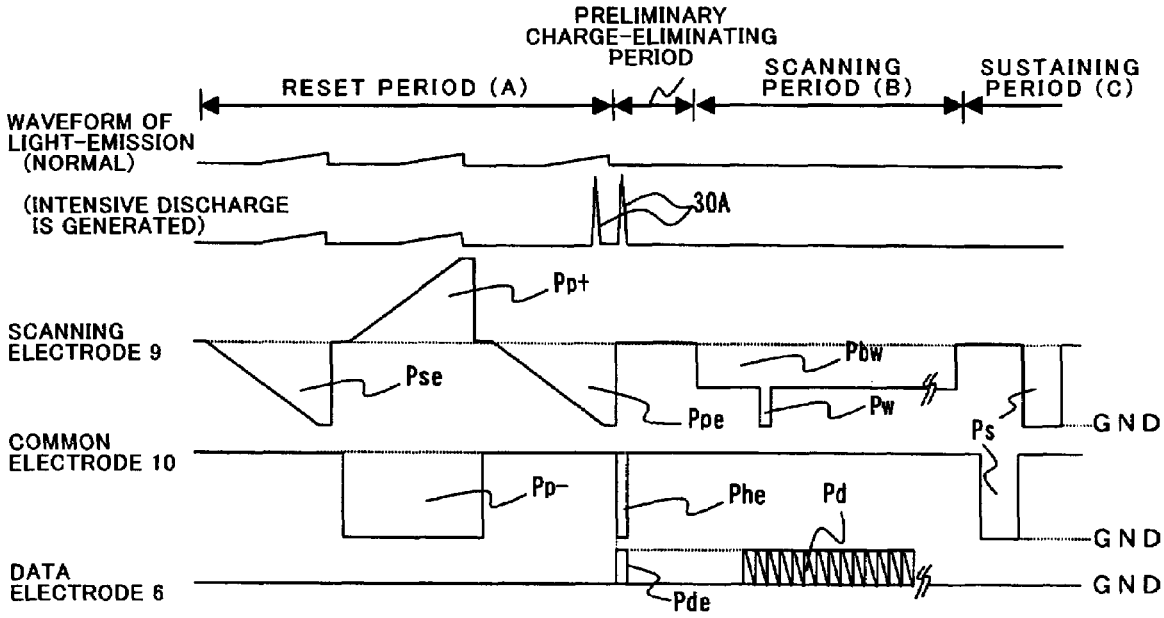
FIG. 14 is a timing chart showing waveforms of pulse voltages applied to electrodes, and further showing waveforms of a light emitted in normal operation and at generation of intensive discharge, in a method of driving a plasma display panel, in accordance with a first example of the fifth embodiment of the present invention.

In a first example of the fifth embodiment, a positive preliminary pulse Pde is applied to the data electrode 6 at a timing at which the preliminary charge-eliminating pulse Phe starts being applied to the common electrode 10, as illustrated in FIG. 14. The application of the preliminary pulse Pde to the data electrode 6 ensures generation of charge-eliminating discharge.

The preliminary pulse Pde is designed to have a pulse width equal to or smaller than a pulse width of the preliminary charge-eliminating pulse Phe. The preliminary pulse Pde is equal in voltage to the data pulse Pd.

Figure 15:
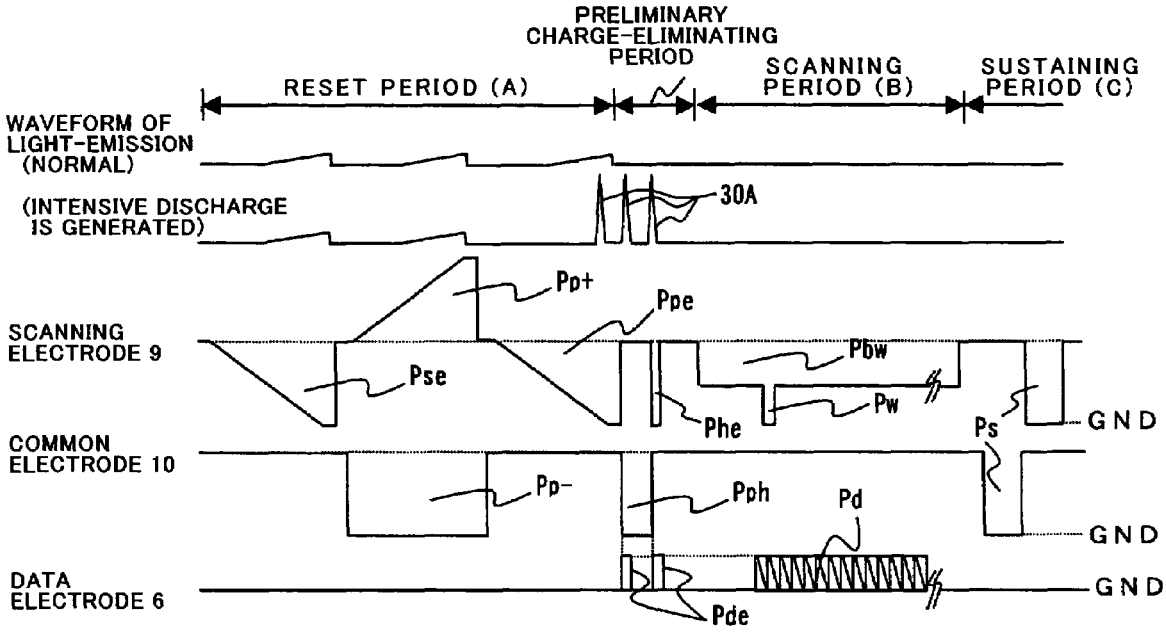
FIG. 15 is a timing chart showing waveforms of pulse voltages applied to electrodes, and further showing waveforms of a light emitted in normal operation and at generation of intensive discharge, in a method of driving a plasma display panel, in accordance with a second example of the fifth embodiment of the present invention.

In a second example of the fifth embodiment, a positive preliminary pulse Pde is applied to the data electrode 6 at a timing at which the preliminary charge-eliminating pulse Phe starts being applied to the scanning electrode 9 and the preliminary pre-eliminating adjusting pulse Pph starts being applied to the common electrode 10, as illustrated in FIG. 15. The application of the preliminary pulse Pde to the data electrode 6 ensures generation of charge-eliminating discharge.

The preliminary pulse Pde is designed to have a pulse width in the range of 0.1 to 2 microseconds. The preliminary pulse Pde is equal in voltage to the data pulse Pd.

Figure 16:
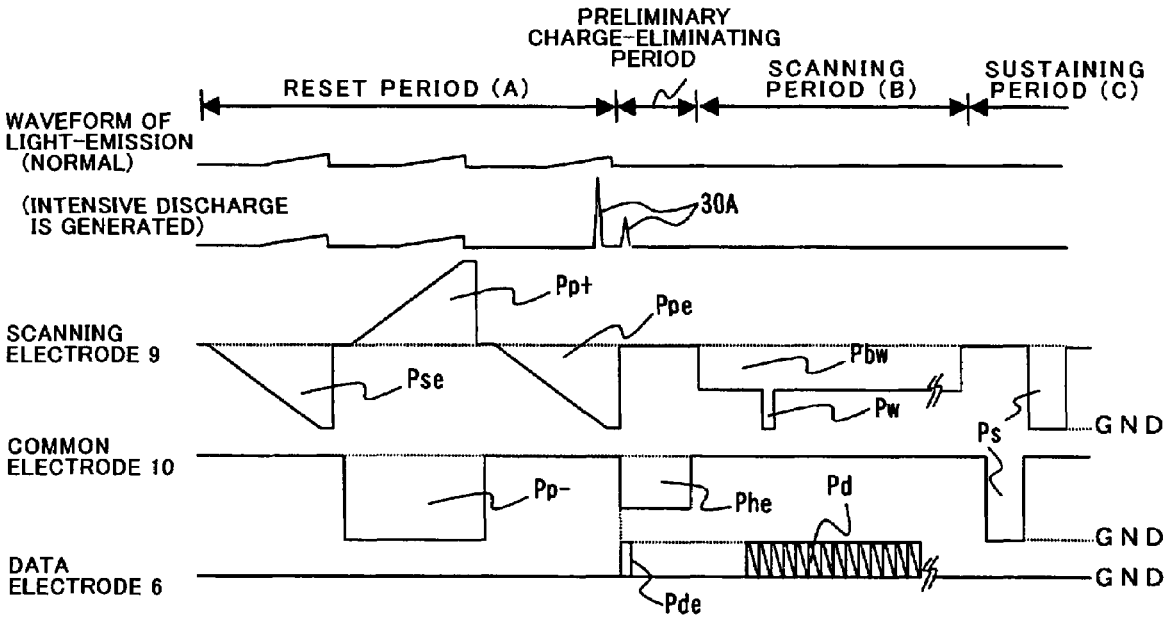
FIG. 16 is a timing chart showing waveforms of pulse voltages applied to electrodes, and further showing waveforms of a light emitted in normal operation and at generation of intensive discharge, in a method of driving a plasma display panel, in accordance with a third example of the fifth embodiment of the present invention.

In a third example of the fifth embodiment, a positive preliminary pulse Pde is applied to the data electrode 6 at a timing at which the preliminary charge-eliminating pulse Phe starts being applied to the common electrode 10, as illustrated in FIG. 16. The application of the preliminary pulse Pde to the data electrode 6 ensures generation of charge-eliminating discharge.

The preliminary pulse Pde is designed to have a pulse width in the range of 0.1 to 2 microseconds. The preliminary pulse Pde is equal in voltage to the data pulse Pd.

Figure 17:
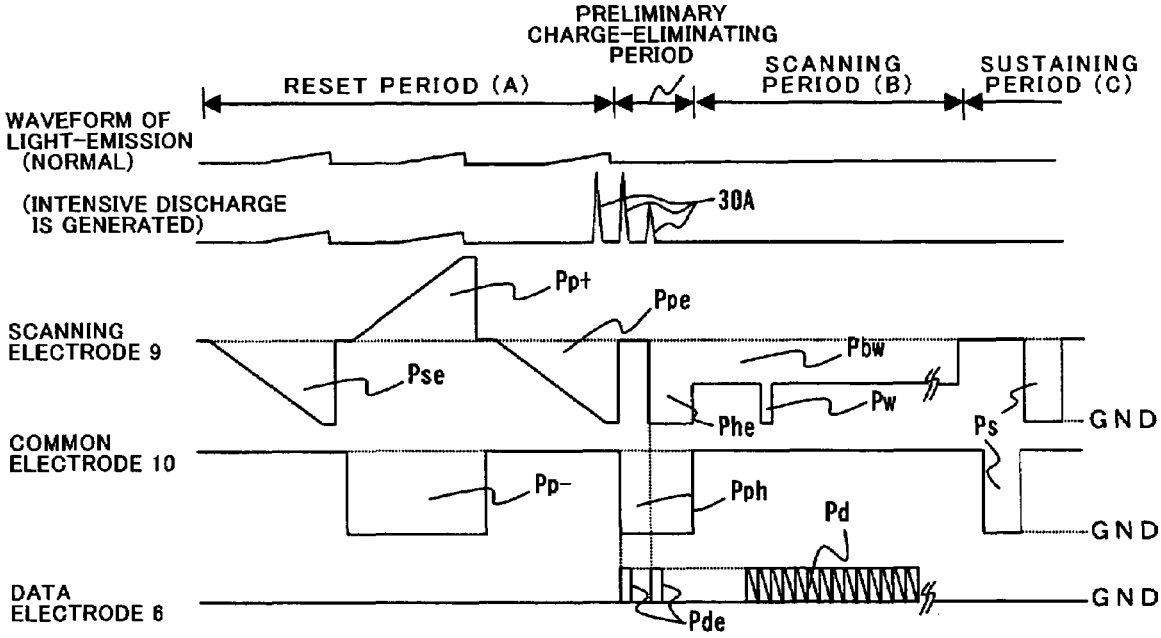
FIG. 17 is a timing chart showing waveforms of pulse voltages applied to electrodes, and further showing waveforms of a light emitted in normal operation and at generation of intensive discharge, in a method of driving a plasma display panel, in accordance with a fourth example of the fifth embodiment of the present invention.

In a fourth example of the fifth embodiment, a positive preliminary pulse Pde is applied to the data electrode 6 at a timing at which the preliminary charge-eliminating pulse Phe starts being applied to the scanning electrode 9 and the preliminary pre-eliminating adjusting pulse Pph starts being applied to the common electrode 10, as illustrated in FIG. 17. The application of the preliminary pulse Pde to the data electrode 6 ensures generation of charge-eliminating discharge.

The preliminary pulse Pde is designed to have a pulse width in the range of 0.1 to 2 microseconds. The preliminary pulse Pde is equal in voltage to the data pulse Pd.

Hereinbelow is explained the reason why charge-eliminating discharge is surely generated by applying the positive preliminary pulse Pde to the data electrode 6.

Figure 8:
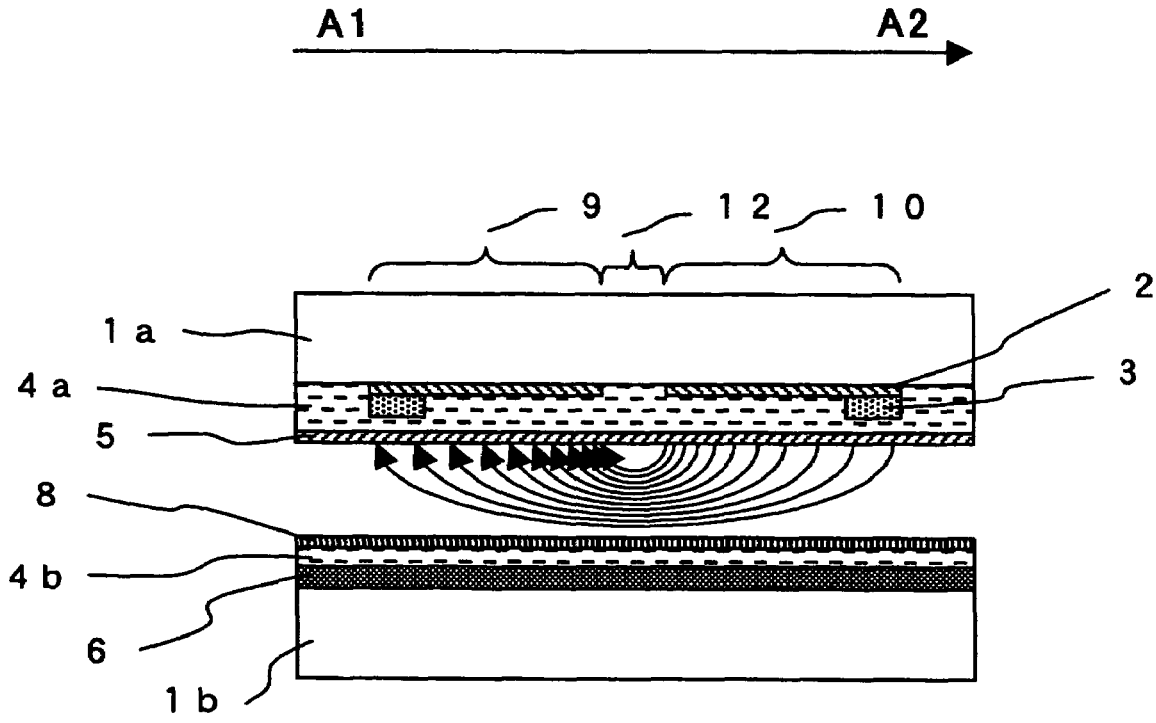
FIG.8 PRIOR ART
FIG. 8 illustrates electric lines of force in an electric field generated between a scanning electrode and a common electrode in the conventional plasma display panel.
Figures 9A, 9B, 9C, 9D, 9E:
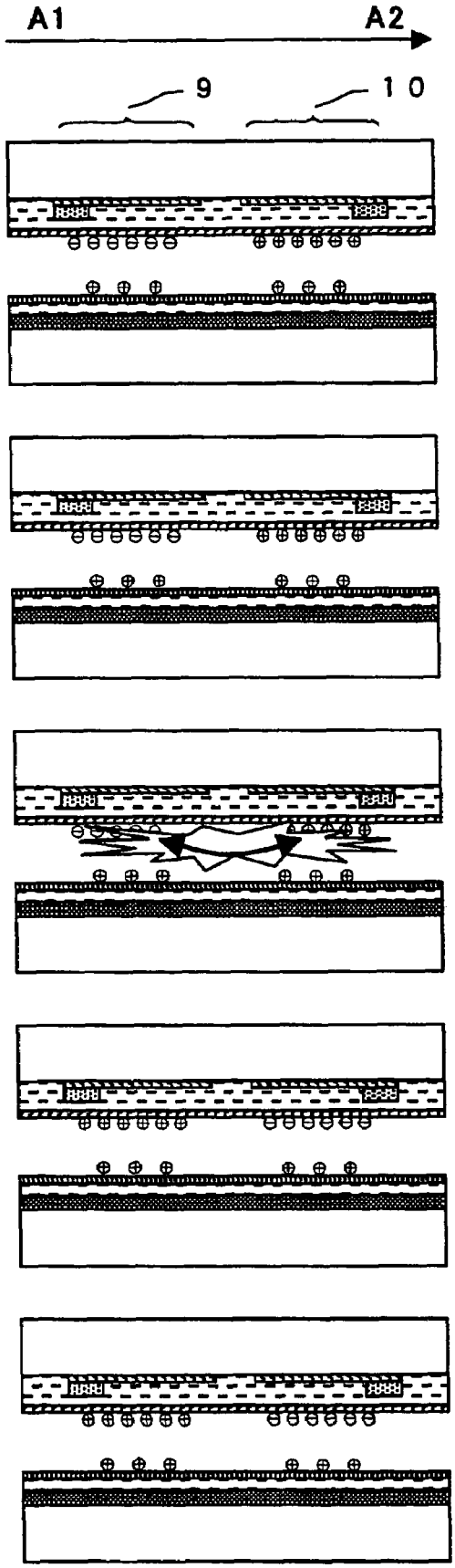
FIG.9A PRIOR ART
FIG.9B PRIOR ART
FIG.9C PRIOR ART
FIG.9D PRIOR ART
FIG.9E PRIOR ART
FIGS. 9A to 9E illustrate arrangement of wall charges in a reset period in the case that there is generated intensive discharge, in the conventional plasma display panel.

Whereas the scanning and common electrodes 9 and 10 are arranged on a common substrate, the scanning and data electrodes 9 and 6 are spaced away from each other with a discharge spaced being sandwiched therebetween and in parallel with each other, and face each other in a large area. Hence, an electric field formed between the scanning and data electrodes 9 and 6 has uniform electric lines of force, as illustrated in FIG. 8.

Since the scanning and data electrodes 9 and 6 face each other in a large area, a ratio at which discharge is generated therebetween is high, and hence, generation of discharge is not so delayed. Accordingly, a voltage difference exceeding a voltage at which discharge is generated between the scanning and data electrodes 9 and 6 is hardly generated. Thus, weak discharge is more stably generated between the scanning and data electrodes 9 and 6 than weak discharge generated between the scanning and common electrodes 9 and 10.

If cross-discharge is generated between the scanning and data electrodes 9 and 6, ions and metastables are much generated in a discharge space, and hence, the discharge space is rendered into an active condition in which discharge is likely to be generated. Hence, surface-discharge is likely to be generated between the scanning and common electrodes 9 and 10, ensuring generation of charge-eliminating discharge.

Though the above-mentioned first to fifth embodiments are applied to a case in which charges are not sufficiently eliminated by priming-eliminating discharge, the first to fifth embodiments may be applied to a case in which charges are not sufficiently eliminated by sustaining-eliminating discharge.

In the second embodiment, wall charges can be rearranged by the application of the preliminary pre-eliminating adjusting pulse Pph and charge-eliminating discharge can be stably generated by the application of the preliminary charge-eliminating pulse Phe. Hence, the second embodiment can generate charge-eliminating discharge more stably than the first embodiment.

The thick-width charge-elimination in accordance with the third embodiment makes it possible to generate charge-eliminating discharge more surely than the first and second embodiments.

In accordance with the fourth embodiment, it is possible to generate charge-eliminating discharge by applying a low voltage to the electrodes by virtue of self-elimination, and design the preliminary charge-eliminating pulse Phe to have a long pulse width. Accordingly, the fourth embodiment can eliminate wall charges more surely and stably than the third embodiment.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2002-357517 filed on Dec. 10, 2002 including specification, claims, drawings and summary is incorporated herein by reference in its entirety.

What is claimed is:

1. A method of driving a plasma display panel comprised of (A) a first substrate including at least one first electrode, and at least one second electrode extending in parallel with said first electrode and defining a display area with said first electrode therebetween, and (B) a second substrate including at least one third electrode facing said first and second electrodes and extending perpendicularly to said first and second electrodes, wherein a display cell is arranged at each of intersections of said first and second electrodes with said third electrode, said method including:

(a) applying a serrate voltage having an inclined waveform in which a voltage varies with the lapse of time, to at least one of said first and second electrodes; and (b) applying a preliminary charge-eliminating pulse voltage to at least one of said first and second electrodes after said a charge-eliminating discharge has been generated due to said serrate voltage, wherein said preliminary charge-eliminating pulse voltage eliminates electric charges only when electric charges have not been sufficiently eliminated.

2. The method as set forth in claim 1, wherein said preliminary charge-eliminating pulse voltage carries out narrow width charge-elimination.

3. The method as set forth in claim 2, wherein said preliminary charge-eliminating pulse voltage has a pulse width in the range of 0.5 to 2 microseconds both inclusive.

4. The method as set forth in claim 1, wherein a negative preliminary charge-eliminating pulse voltage is applied to said second electrode.

5. The method as set forth in claim 1, wherein a positive preliminary charge-eliminating pulse voltage is applied to said first electrode.

6. The method as set forth in claim 1, wherein negative and positive preliminary charge-eliminating pulse voltages are concurrently applied to said second and first electrodes, respectively.

7. The method as set forth in claim 1, further including (c) applying a preliminary pre-eliminating adjusting pulse voltage to at least one of said first and second electrodes to cause generate discharge in a display cell in which electric charges have not been sufficiently eliminated, said step (c) being carried out between said steps (a) and (b).

8. The method as set forth in claim 7, wherein said preliminary pre-eliminating adjusting pulse voltage is applied to an electrode other than an electrode to which said preliminary charge-eliminating pulse voltage is applied.

9. The method as set forth in claim 7, wherein said preliminary pre-eliminating adjusting pulse voltage has a pulse width greater than a pulse width of said preliminary charge-eliminating pulse voltage.

10. The method as set forth in claim 7, wherein said preliminary pre-eliminating adjusting pulse voltage is applied a plurality of times to at least one of said first and second electrodes in said step (c).

11. The method as set forth in claim 7, wherein said preliminary pre-eliminating adjusting pulse voltage has a pulse width in the range of 2 to 10 microseconds both inclusive.

12. The method as set forth in claim 7, wherein said preliminary pre-eliminating adjusting pulse voltage is applied to at least one of said first and second electrodes immediately before application of said preliminary charge-eliminating pulse voltage.

13. The method as set forth in claim 7, wherein said preliminary pre-eliminating adjusting pulse voltage has the same polarity as that of said preliminary charge-eliminating pulse voltage.

14. The method as set forth in claim 7, wherein said preliminary pre-eliminating adjusting pulse voltage generates an electric field having a polarity opposite to a polarity of an electric field generated by said preliminary charge-eliminating pulse voltage.

15. The method as set forth in claim 1, wherein said preliminary charge-eliminating pulse voltage carries out thick-width charge-elimination.

16. The method as set forth in claim 15, wherein said preliminary charge-eliminating pulse voltage has a pulse width in the range of 2 to 50 microseconds both inclusive.

17. The method as set forth in claim 1, wherein said preliminary charge-eliminating pulse voltage is comprised of a self-eliminating pulse voltage.

18. The method as set forth in claim 17, wherein a preliminary pre-eliminating adjusting pulse voltage is applied to an electrode other than an electrode to which said self-eliminating pulse voltage is applied such that said preliminary pre-eliminating adjusting pulse voltage temporally overlaps said self-eliminating pulse voltage, to generate discharge in a display cell in which electric charges have not been sufficiently eliminated.

19. The method as set forth in claim 17, wherein said self-eliminating pulse voltage has a pulse width in the range of 2 to 50 microseconds both inclusive.

20. The method as set forth in claim 17, wherein said preliminary charge-eliminating pulse voltage is applied to at least one of said first and second electrodes as a part of a pulse voltage applied in a scanning period.

21. The method as set forth in claim 1, wherein a time at which cross-discharge is generated between said third electrode and one of said first and second electrodes is set earlier than a time at which surface-discharge is generated between said first and second electrodes.

22. The method as set forth in claim 21, wherein a preliminary pulse voltage is applied to said third electrode in synchronization with a timing at which application of said preliminary charge-eliminating pulse voltage starts, said preliminary pulse voltage having a polarity opposite to a polarity of said preliminary charge-eliminating pulse voltage.

23. The method as set forth in claim 21, wherein a preliminary pulse voltage is applied to said third electrode in synchronization with a timing at which application of said preliminary pre-eliminating adjusting pulse voltage starts, said preliminary pulse voltage having a polarity opposite to a polarity of said preliminary pre-eliminating adjusting pulse voltage.

24. The method as set forth in claim 22, wherein said preliminary pulse voltage is equal to a data pulse voltage.

25. The method as set forth in claim 22, wherein said preliminary pulse voltage has a pulse width in the range of 0.1 to 2 microseconds both inclusive.

26. The method as set forth in claim 22, wherein said preliminary pulse voltage has a pulse width equal to or smaller than a pulse width of said preliminary charge-eliminating pulse voltage.

* * * * *